United States Patent [19]

Bert

[11] 4,076,175

[45] Feb. 28, 1978

[54] ADJUSTABLE INDUSTRIAL PAINT SPRAYER

[76] Inventor: Walter J. Bert, 213 N. Emerald Drive, McHenry, Ill. 60050

[21] Appl. No.: 717,228

[22] Filed: Aug. 24, 1976

[51] Int. Cl.[2] ..... B05B 13/02

[52] U.S. Cl. ..... 239/532; 134/199; 239/587

[58] Field of Search ..... 134/64 R, 122 R, 199; 239/280, 280.5, 532, 567, 587; 118/305, 307

[56] References Cited

U.S. PATENT DOCUMENTS

| | | | |
|---|---|---|---|
| 1,511,361 | 10/1924 | Paasche | 239/532 X |
| 1,829,831 | 11/1931 | Hiskey | 118/307 |
| 1,960,725 | 5/1934 | Bramsen et al. | 118/307 |
| 2,593,295 | 4/1952 | Granfield | 239/532 |
| 3,334,639 | 8/1967 | Grant | 134/199 X |
| 3,994,443 | 11/1976 | Shenker | 239/567 X |

*Primary Examiner*—John J. Love
*Assistant Examiner*—Michael Mar

[57] ABSTRACT

Industrial spraying apparatus for applying paint to an overhead pipe or the like that contains a pair of spaced apart contoured support members adapted to extend in surrounding relation to the pipe to be sprayed and having a passageway contained therein, with a nozzle mounted on each of the support members in communicating relation with the passageway and directed in the direction of the pipe so as to obtain an application of the paint onto the pipe. A paint supply is connected to each of the support members and communicating with each passageway, to provide a constant flow of paint to the nozzles. A mounting bracket is provided for pivotally connecting the support members and extension bracket connected to the mounting bracket at substantially one end thereof and adapted to receive interchangeable handles of various lengths so as to permit the user of the spraying apparatus to retain and move the support members relative to the pipe to be sprayed is also provided.

3 Claims, 1 Drawing Figure

ADJUSTABLE INDUSTRIAL PAINT SPRAYER

BACKGROUND OF THE INVENTION

The present invention relates to a paint spraying device and more particularly to industrial spraying apparatus for applying paint to an overhead pipe, or the like.

In the maintainance of industrial buildings it is often necessary to repaint various overhead pipe lines that may be made from a variety of materials. Since these pipe lines generally extend overhead and cannot be reached unless standing on a ladder, it has been necessary to painstakingly paint these pipes. In many instances it is also difficult to gain access behind the pipes in order to be assured that a coating of paint has been applied thereto.

OBJECTS OF THE PRESENT INVENTION

An object of the present invention is to provide an industrial spraying apparatus for applying paint to overhead pipes or the like.

Another object of the present invention is to provide a spraying apparatus that is adjustable to various size pipes to be painted.

Another object of the present invention is to provide an industrial spraying apparatus which may be manually supported by the user during operation thereof.

Other objects and advantages of the invention will become apparent as the disclosure proceeds.

SUMMARY OF THE INVENTION

Industrial spraying apparatus for applying paint to an overhead pipe or the like, that includes support means including a pair of spaced apart contoured support members adapted to extend in surrounding relation to, or on each side of, the pipe to be sprayed and having a passageway contained therein. Nozzle means including a nozzle mounted on each of the support members in communicating relation with the passageway and directed in the direction of the pipe so as to obtain an application of the paint onto the pipe is provided.

Paint supply means is connected to each of the support members and communicating with each passageway to provide a constant supply of paint. Mounting means for pivotally connecting the support members at substantially one end thereof to provide angular positionment so as to obtain an adjustment between the nozzles such that pipes of various sizes may extend therebetween for painting is provided. Extension means is connected to the mounting means at substantially one end thereof and adapted to receive interchangeable handles of various lengths so as to permit the user of the spraying apparatus to retain and move the support members relative to the pipe to be sprayed. The industrial spraying apparatus further includes air supply means connected to each of the support members adjacent the paint supply means and communicating with each passageway.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
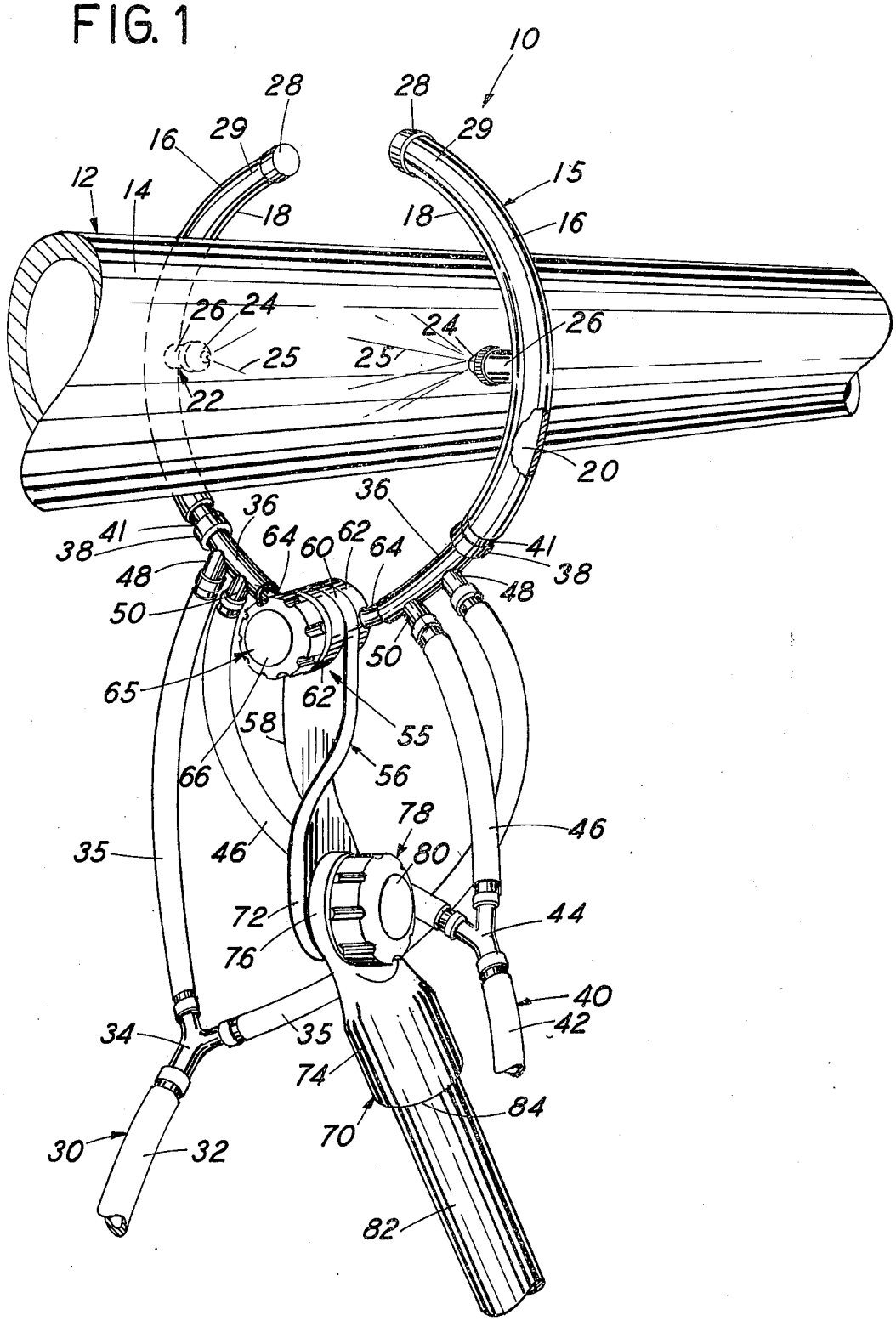
FIG. 1 is perspective view of an industrial paint spraying device in accordance with the present invention.

The present invention is illustrated in FIG. 1 and includes an industrial spraying apparatus 10 for applying paint or other materials to an overhead pipe 12 having an outer surface 14. Although a pipe has been illustrated in FIG. 1, it is appreciated that the pipe may in fact be a beam or iron channel utilized in certain buildings, and that the pipe may contain air or other materials flowing therethrough.

The spraying apparatus 10 includes support means 15 that includes a pair of spaced apart contoured support members 16 having an inner surface 18 which are adapted to extend in surrounding relation to the pipe 12 to be sprayed. Each support member includes a passageway 20 contained therein and if desired each support member 16 may be made of tubular material such as metal or plastic.

To apply the fluid, such as paint, nozzle means 22 is provided and may include a nozzle 24 mounted on each support member 16 in communicating relation with the passageway 20 and directed in the direction of the pipe 12 so as to obtain an application of the paint 25 exiting from each nozzle 24. The nozzle spray pattern may be varied by providing each nozzle 24 with an adjustable head such that depending upon the size of the pipe 12 proper coverage may be obtained. The nozzle 24 extends inwardly from each surface 18 and has a branch member 26 that is connected as by welding or some other means to each support member 16.

Plugs or caps 28 are provided at the upper end 29 of each support member to seal off the passageway 20 to prevent the escape of paint therefrom. Paint supply means 30 is provided and may be transmitted to the nozzles 24 by means of a paint line 32 from a compressor (not shown) that is connected to a forked branch member 34 having a pair of branch paint conduits 35 connected to an extension member 36 extending outwardly from the bottom end 38 of each support member 16 and sealed with respect thereto as by a clamp 41. The paint 25 passes through this branch network and terminates at the nozzle 24 since each extension member 36 and branch conduit 35 are in communicating relationship with the passageway 20. To assist the flow and atomize the paint, air supply means 40 is provided and air is forced through conduit 42 into a forked branch member 44 which in turn is connected with a pair of air conduits 46 which are in turn connected to the extension members 36. As seen in FIG. 1 the connection of the air supply means 40 is behind the juncture 48 connecting the paint line conduit 35 to the extension member 36. The air line conduit 46 are connected by juncture members 50 which are spaced further from the nozzle 24 than the fitting 48.

As described above, the paint supply means 30 and air supply means 40 are maintained operational so that the atomized paint 25 continuously flows from the nozzles 24. In order to vary the spacing between the nozzles 24 for different size pipes 12 mounting means 55 is provided for pivotally connecting the support members 16 at substantially one end thereof to provide angular positionment so as to obtain an adjustment between the nozzles 24 such that pipes 12 of various sizes may be accommodated therebetween for painting.

The mounting means 55 includes bracket means 56 formed by a bracket member 58 having an upper end 60 adapted to accommodate a flanged member 62 that is connected by a neck member 64 to the extension member 36 and in sealed relation thereto. In similar fashion the other extension member 36 similarly includes a flanged member 62 and a neck member 64. The upper end of the bracket 58 extends in overlapping relationship with the spaced apart flanged members 62 and coupling means 65 is provided for releasably retaining the bracket 58 at its upper end 60 in relatively fixed relation to the coupling means 65 which may include a gripping member 66 that when tightened compresses the respective overlapping surfaces together. A threaded shaft (not shown) may be received in the gripping member 66 to accomplish the above. In this manner the spatial relationship of the support members 18 are easily adjusted and maintained.

To assist the user extension means 70 is provided and connected at the lower end 72 of the mounting bracket 58 as seen in FIG. 1, the lower end 72 as compared to the upper end 60 may be rotated by ninety degrees. The mounting means 70 includes a mounting member 74 having a upper head portion 76 for overlapping engagement with the lower end 72 of the bracket 58. Locking means 78 may be provided in the form of a locking member 80 adapted to be manually tightened and released so as to permit relative angular positionment of the extension means 70. An extension member 82 in the form of a handle is adapted to be received in telescopic relation with the lower end 84 of the mounting member 74. This permits the user to adjust the apparatus 10 to the particular height of the pipe 12 such that if desired by standing on the floor spraying of the pipe 12 may still be accomplished.

The ability to utilize the extension means 70 at various angular positions further facilitates gaining access to various positions or corners in a building, particularly in the boiler room or at the basement level where access thereto would normally be difficult.

Although an illustrative embodiment of the invention has been described in detail herein with reference to the accompanying drawings, it is to be understood that the invention is not limited to the precise embodiment, and that various changes and modifications may be effected therein without departing from the scope or spirit of the invention.

I claim:

1. Industrial spraying apparatus for applying paint to an overhead pipe or the like, comprising:

a. support means including a pair of spaced apart contoured support members adapted to extend in surrounding relation to the pipe to be sprayed and having a passageway contained therein, b. nozzle means including a nozzle mounted on each of said support members in communicating relation with said passageway and directed in the direction of the pipe so as to obtain an application of the paint onto the pipe, c. paint supply means connected to each of said support members and communicating with each said passageway, d. air supply means connected to each of said support members adjacent said paint supply means and communicating with each said passageway, e. mounting means for pivotally connecting said support members at substantially one end thereof to provide angular positionment so as to obtain an adjustment between said nozzles such that pipes of various sizes may extend therebetween for painting, f. extension means connected to said mounting means at substantially one end thereof and including an extension member adapted to receive interchangeable handles of various lengths so as to permit the user of the spraying apparatus to retain and move said support members relative to the pipe to be sprayed, g. locking means pivotally adjustable relative to said mounting means so as to permit angular adjustment of the interchangeable handles relative to said support means, h. said mounting means includes i. a bracket, ii. a flanged member extending from one end of each of said support members in overlapping relationship to said bracket, and iii. coupling means for releasably retaining said bracket and said flanged members in fixed relationship to each other, i. said support means includes iv. an extension member extending from one end of each said support member, v. a neck portion extending from each said flanged member and adapted to be received by said extension member, vi. means connecting said paint supply means to each said extension member, and vii. means connecting said air supply means to each said extension member.

2. Industrial spraying apparatus as defined in claim 1, wherein said air supply means is connected to said support member below the connection of said paint supply means.

3. Industrial spraying apparatus as defined in claim 1, wherein said passageway in said support members are sealed at each end thereof.

* * * * *